United States Patent [19]

Jahnke et al.

[11] 4,264,800

[45] Apr. 28, 1981

[54] MICROWAVE OVEN WINDOW

[75] Inventors: Merlin R. Jahnke, Woodbury; Alfred D. Nelson, Stillwater, both of Minn.

[73] Assignee: Minnesota Mining and Manufacturing Company, St. Paul, Minn.

[21] Appl. No.: 47,345

[22] Filed: Jun. 8, 1979

[51] Int. Cl.[3] ..... H05B 6/76

[52] U.S. Cl. ..... 219/10.55 D; 126/200; 156/99; 174/35 MS

[58] Field of Search ..... 219/10.55 D, 10.55 F, 219/10.55 R; 174/35 MS, 35 R; 126/200; 156/99

[56] References Cited

U.S. PATENT DOCUMENTS

| | | | |
|---|---|---|---|
| 2,920,174 | 1/1960 | Haagensen | 219/10.55 D X |
| 2,958,754 | 11/1960 | Hahn | 219/10.55 D |
| 3,431,348 | 3/1969 | Nellis et al. | 219/10.55 D X |
| 3,843,859 | 10/1974 | Klemp et al. | 219/10.55 D |

*Primary Examiner*—Arthur T. Grimley

[57] ABSTRACT

Microwave oven window having a microwave-blocking screen, an interior plastic film and a pressure-sensitive adhesive layer bonding the plastic film to the screen over the full area of the screen but substantially not penetrating into the openings of the screen.

14 Claims, 3 Drawing Figures

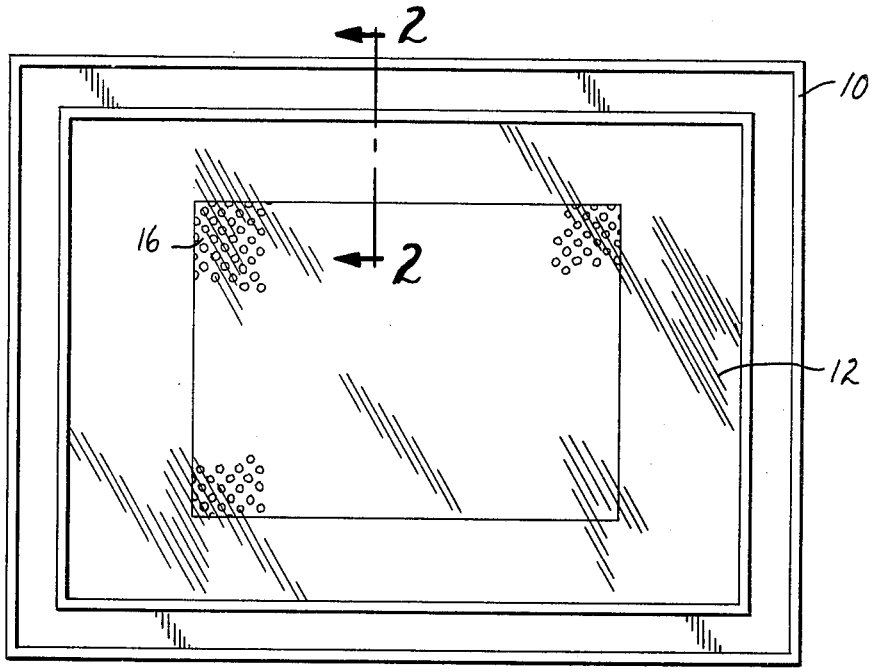
FIG. 1
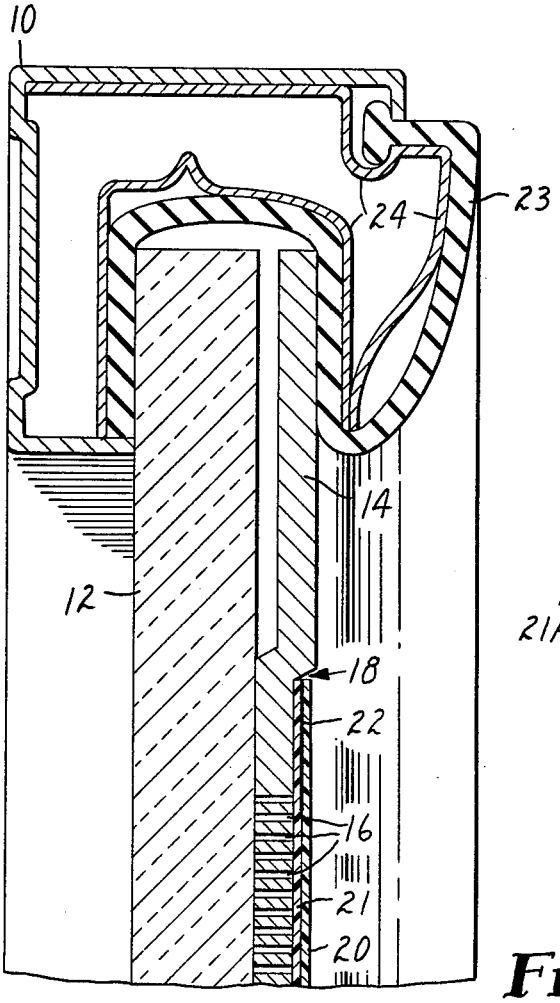
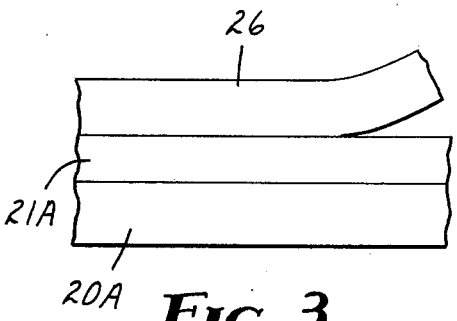
FIG. 3
FIG. 2

MICROWAVE OVEN WINDOW

FIELD OF THE INVENTION

This invention concerns an improved microwave oven window construction, a new composite useful for making the window, and the method of making the new composite.

BACKGROUND OF THE INVENTION

A typical microwave oven door has a metal frame comprising a microwave-blocking screen sandwiched between a pair of transparent panels. As shown in FIG. 3 of U.S. Pat. No. 3,843,859, the exterior transparent panel may be glass and the interior panel may be a relatively thin plastic film such as a polycarbonate film. A pair of epoxy adhesive layers bond the screen to the glass panel and, in turn, the polycarbonate film to the screen. According to column 3, lines 8–12, the adhesive layers can either be coextensive with the screen or only extend around the border. Prior to the present invention, most microwave oven windows being produced employed a pair of pressure-sensitive adhesive layers around the border.

A window of especially economical construction employs an exterior glass panel and a coextensive conductive metal panel which has a central, perforated area that functions as a window with a microwave-blocking screen. An area of the metal panel somewhat larger than the perforated window area is indented away from the interior of the oven, and a transparent plastic film is adhered to the indented area by a pressure-sensitive adhesive transfer tape extending along the periphery of the plastic film. Because the plastic film is virtually the same size as the indented area and the metal panel is indented to a somewhat greater extent than the total thickness of the plastic film and the adhesive, the edges of the plastic film are protected from being accidentally caught during the movement of articles through the oven doorway. The mismatch in coefficient of thermal expansion between the metal panel and the plastic film tends to warp the plastic film. While the resultant optical distortion may be minor, this mars the esthetic appearance and is interpreted as a mark of low quality. To minimize this, the plastic film is made semi-rigid by being fairly thick, usually at least 20 mils. Because polyester film is not readily available in that thickness, polycarbonate film has almost always been used, even though it has rather high water-vapor transmission.

One advantage of that construction is that leakage of microwaves is minimized because the interior surface of the metal panel contacts the frame of the door. In a microwave oven door wherein the microwave-blocking screen covers the full door and an interior plastic panel is coextensive with the screen, there may be a path for leakage through that panel.

THE PRESENT INVENTION

The microwave oven window of the present invention, like the above-described window having an indented metal panel, comprises a microwave-blocking screen sandwiched between an exterior glass panel and an interior heat-resistant transparent plastic film. Also as in that prior window, the microwave-blocking screen can be provided by a central perforated window area in a conductive metal panel and there may be a somewhat larger indented area into which the plastic film may be fitted and adhered by an adhesive layer. Unlike that prior window, the adhesive layer of the window of the present invention is coextensive with the plastic film and hence must be transparent, and it is bonded over its full area to the microwave-blocking screen. In spite of this, the adhesive layer does not noticeably interfere with vision through the window area. One skilled in the art would have expected that any adhesive which would securely bond the plastic film to the entire window area of the perforated screen would wet out the surface of the screen such that a meniscus effect would be created in each perforation. In our first attempt to do so, the pressure-sensitive adhesive gradually flowed into the perforations so that within a day or two, the window area became translucent.

We have found that a pressure-sensitive adhesive can securely bond an interior plastic film to the entire window area without noticeable reduction in vision if the pressure-sensitive adhesive is 1–4 mils thick and has a resistance to 90° peelback at 12 inches per minute from stainless steel at 70° F. of at least one pound per inch of width (FTMS 2050/70) and a resistance to a shear load of 1000 grams per inch square at 120° F. of at least 10 minutes (ASTM D3654/78). This adhesive substantially does not penetrate into the openings of the screen.

By adhesively bonding the entire interface between the plastic film and the conductive metal panel, the thickness of the plastic panel can be greatly reduced. Not only does this effect a significant reduction in cost, but it permits the use of polyester film which has much lower water-vapor transmission than does polycarbonate film. Also there is no noticeable warping of the plastic film, and the plastic film and the window area of the metal panel reinforce each other.

In oven door constructions where the interior plastic film is coextensive with the microwave-blocking screen, the reduced thinness of the plastic film greatly reduces any microwave leakage. Such constructions sometimes use other types of microwave-blocking screens such as wire mesh with which the present invention is also useful.

The pressure-sensitive adhesive of the present invention preferably is an acrylate copolymer of U.S. Pat. No. Re. 24,906, that is, an acrylate copolymer of monomers (a) acrylic acid ester of non-tertiary alcohol, the molecules of which have from 1–14 carbon atoms, the average being about 4–12 carbon atoms, at least a major proportion of said molecules having a carbon-to-carbon chain of at least 4 carbon atoms terminating at the hydroxyl oxygen atoms, said chain containing at least about ½ the total number of carbon atoms in the alcohol molcule, said acrylic acid ester being per se polymerizable to a sticky, stretchable elastic adhesive polymer mass, and (b) at least one copolymerizable monoethylenic monomer selected from the group consisting of acrylic acid, methacrylic acid, acrylamide, methacrylamide and itaconic acid.

The total copolymerizable monomer (b) comprises about 3 to 12 percent by weight of the total of said monomers (a) and (b). Best results have been attained using acrylate copolymers having inherent viscosities of at least 1.5, especially at low levels of said monomer (b). The acrylate copolymers are exceedingly clear and transparent and remain so for years in spite of prolonged exposure to temperatures generated within microwave ovens.

Silicone pressure-sensitive adhesives should also be useful such as General Electric SR 574 or Dow-Corning 280A. These are quite expensive and hence less preferred.

In order to provide good transparency, the pressure-sensitive adhesive layer should be formed on the surface of the plastic film. This may be accomplished by applying to the plastic film a coating of pressure-sensitive adhesive in a volatile vehicle and heating to drive off the vehicle. To provide a preferred acrylate copolymer adhesive layer, a radiation-sensitized solventless mixture of a polymerizable or partially polymerized monomers (a) and (b) can be coated onto the plastic film and polymerized by radiation in the near ultraviolet region as in U.S. Pat. No. 4,181,752 . This technique tends to produce higher molecular weight, thus better assuring the desired resistance to shear load. It also tends to provide better flatness of the open face of the pressure-sensitive adhesive layer.

After the coated monomers have been polymerized to a pressure-sensitive adhesive state or, if the adhesive was applied from a solution or emulsion, after substantially all volatile material has been driven off, a soft, conformable, removable, low-adhesion, plastic liner is applied to protect the adhesive. The soft, conformable nature of the liner permits the entire composite to be wound upon itself without peaking or gapping.

Preferred as the plastic liner is polyethylene film which is inexpensive and desirably soft, conformable and durable. Also useful for making the plastic liner are copolymers of polyethylene and polypropylene and rubbery block copolymers of about 50–80 parts by weight butadiene and correspondingly 50–20 parts styrene having an average molecular weight exceeding 50,000.

When coating an acrylate copolymer pressure-sensitive adhesive from solution or emulsion without crosslinking, good resistance to shear load is more reliably attained if the copolymerizable monomer (b) comprises at least 8% by weight of the total monomers (a) and (b). Higher resistance to shear load is attainable by crosslinking as in U.S. Pat. Nos. 2,973,286 or 2,925,174, in which case said monomer (b) may be as low as about 2%. The peroxide crosslinking taught in the former patent does not affect the transparency, whereas some of the crosslinkers of the latter may produce some coloring. However, such coloring should not cause noticeable reduction in visibility because the adhesive layer ought to be quite thin.

The thickness of the adhesive layer should be at least one mil in order to provide adequate adhesion. A thickness of 1–3 mils is preferred. Above about four mils would be economically wasteful.

The thickness of the plastic film should be about 2 mils or more, because a substantially thinner film would be difficult to coat and to handle. Above about 8 mils would be economically wasteful. About 2 to 5 mils are preferred.

As noted above, polyester films are preferred because of their low water-vapor transmission. Of these, biaxially-oriented polyethylene terephthalate is especially useful, being readily available at low cost and having good dimensional stability and resistance to degradation in spite of exposure to heat and various chemicals. It is readily produced with good transparency and can be produced with exceedingly high clarity as taught in U.S. Pat. No. 3,592,797. Somewhat less useful are the polycarbonates.

THE DRAWING

In the drawing:

FIG. 1 is a schematic elevation of a microwave oven door including a window embodying the invention;

FIG. 2 is an enlarged cross-section along line 2—2 of FIG. 1; and

FIG. 3 is an enlarged schematic side view of a composite useful for making the window shown in FIGS. 1 and 2.

The illustrated door comprises a metal frame 10 for an exterior glass panel and a microwave-blocking screen in the form of a conductive metal panel 14 which has central perforations 16. An area of the metal panel which is somewhat larger than the perforated area is indented at 18 (FIG. 2). A clear plastic film 20 is adhered to the entire indented area by a pressure-sensitive layer 21 which is coextensive with the plastic film but substantially does not penetrate into the perforations 16. An area of the plastic film which slightly exceeds the unperforated indented area of the metal panel 14 is imprinted with opaque ink 22 on the face bonded to the adhesive layer 21. This provides a cleaner, and hence more esthetic, edge to the window than would the perforations. A microwave-blocking gasket 23 provides a microwave- and heat-blocking seal to the body of the oven (not shown) when the door is closed. The gasket consists of plasticized polyvinyl chloride highly filled with conductive carbon particles and is retained by a thin steel spring 24.

FIG. 3 schematically shows a composite useful for making the illustrated window which can be wound up into roll form for convenience. The composite includes a thin flexible plastic film 20A carrying a pressure-sensitive adhesive layer 21A which is protected by a soft, conformable low-adhesion plastic liner 26 which is shown being stripped away. Before removing the liner, the composite is die-cut to size. Then the liner is removed, and the adhesive layer is laid against the indented area of the metal panel. Overall contact is made under light pressure with a hard rubber roll, taking care not to force the adhesive into the openings of the metal panel.

A preferred microwave oven window of the invention as illustrated in the drawing has:

Metal panel 14: Aluminum sheet 30 mils in thickness

Perforations 16: Approximating ½ the perforated area

Indentation at 18: About 15 mils

Plastic film 20: Photographic grade (free of gel particles) biaxially-oriented polyethylene terephthalate film of 5-mil thickness Pressure-sensitive adhesive 21: Essentially as disclosed in Example 2 of the aforementioned Ser. No. 945,406, filed Sept. 25, 1978, and 2 mils in thickness Liner 26: 4-mil high-density polyethylene film having a silicone coating, e.g., UBL-70-1 coating applied by Akrosil Corporation.

A pressure-sensitive adhesive tape consisting of the above-identified plastic film 20 and pressure-sensitive adhesive 21 exhibited a resistance to 90° peelback as described above of two pounds per inch of width. Its resistance to shear load was 20 minutes measured by the aforementioned ASTM test method except the strip was only ½ inch in width.

We claim:

1. In a microwave oven window comprising a perforated microwave-blocking screen sandwiched between an exterior glass panel and an interior transparent plastic film wherein a layer of transparent adhesive coextensive with the plastic film bonds the film to the screen, the improvement comprising:

the adhesive is a pressure-sensitive adhesive 1 to 4 mils thick which has a resistance to 90° peelback at 12 inches per minute from stainless steel at 70° F. of at least one pound per inch of width, a resistance to a shear load of 1000 grams per inch square at 120° F. of at least 10 minutes, and substantially does not penetrate into the openings of the screen.

2. In a microwave oven window as defined in claim 1 the further improvement comprising:

said pressure-sensitive adhesive is an acrylate copolymer.

3. In a microwave oven window as defined in claim 1 the further improvement comprising:

the microwave-blocking screen is a central, perforated area of a metal panel and the plastic film is larger than the perforated area but smaller than the entire metal panel.

4. In a microwave oven window as defined in claim 3 the further improvement comprising:

the perforated area of said metal panel is indented to a greater extent than the thickness of said film and the film covers substantially the entire indented area so that its edges are protected.

5. A composite useful for making microwave oven windows, said composite comprising:

a transparent plastic film which is at least as wide as the microwave oven windows and bears a coextensive transparent pressure-sensitive adhesive layer 1 to 4 mils in thickness which has a resistance to 90° peelback at 12 inches per minute from stainless steel at 70° F. of at least one pound per inch of width and a resistance to a shear load of 1000 grams per inch square at 120° F. of at least 10 minutes and when said plastic film is adhered by said adhesive layer to a perforated microwave-blocking screen, the adhesive substantially does not penetrate into the openings of the screen, and a removable low-adhesion plastic liner protecting the adhesive.

6. A composite as defined in claim 5 wherein said transparent plastic film is imprinted with an opaque border.

7. A composite as defined in claim 5 wherein the pressure-sensitive adhesive has been formed in situ on said transparent plastic film.

8. Method of making a composite useful for making a microwave oven window comprising the steps of:

(a) forming on the surface of a transparent plastic film a coextensive transparent pressure-sensitive adhesive layer 1 to 4 mils in thickness which has a resistance to 90° peelback at 12 inches per minute from stainless steel at 70° F. of at least one pound per inch of width and a resistance to a shear load of 1000 grams per inch square at 120° F. of at least 10 minutes, and when said plastic film is adhered by said adhesive layer to a perforated microwave-blocking screen, the adhesive substantially does not penetrate into the openings of the screen, and (b) covering the adhesive layer with a removable low-adhesion plastic liner.

9. Method of making a composite as defined in claim 8 wherein step (a) involves forming said adhesive layer by applying to said plastic film a coating of pressure-sensitive adhesive in a volatile vehicle and driving off substantially all of the vehicle before carrying out step (b).

10. Method of making a composite as defined in claim 8 wherein step (a) involves applying a coating of monomers which polymerize to a pressure-sensitive adhesive state and then polymerizing the monomers.

11. Method of making a composite as defined in claim 10 wherein the polymerizing is initiated by ultraviolet light.

12. Method of making a composite as defined in claim 8 wherein said film has been imprinted with opaque areas prior to step (a) and there is an additional step (c) of die-cutting the composite to form approximately window-size panels having the opaque areas at their borders.

13. A composite as defined in claim 5 wherein the thickness of the transparent plastic film is 2 to 8 mils.

14. Method as defined in claim 8 wherein the thickness of the transparent plastic film is 2 to 8 mils.

* * * * *

Dedication 4,264,800.—*Merlin R. Jahnke,* Woodbury, and *Alfred D. Nelson,* Stillwater, Minn. MICROWAVE OVEN WINDOW. Patent dated Apr. 28, 1981. Dedication filed Aug. 13, 1984, by the assignee, *Minnesota Mining and Manufacturing Co.*

Hereby dedicates said patent to the Public.

[*Official Gazette November 6, 1984.*]